United States Patent [19]

Wada et al.

[11] Patent Number: 4,662,429

[45] Date of Patent: May 5, 1987

[54] COMPOSITE MATERIAL HAVING MATRIX OF ALUMINUM OR ALUMINUM ALLOY WITH DISPERSED FIBROUS OR PARTICULATE REINFORCEMENT

[75] Inventors: Tsuguyasu Wada, Ann Arbor, Mich.; Daniel J. Adenis, Lancaster, Pa.; Thomas B. Cox, Ann Arbor, Mich.

[73] Assignee: AMAX Inc., Greenwich, Conn.

[21] Appl. No.: 896,155

[22] Filed: Aug. 13, 1986

[51] Int. Cl.[4] ..... B22D 19/14

[52] U.S. Cl. ..... 164/461; 164/97; 428/627

[58] Field of Search ..... 164/97, 108, 109, 110, 164/461, 57.1, 58.1; 428/627

[56] References Cited

U.S. PATENT DOCUMENTS 4,053,011 10/1977 Riewald et al. ..... 164/97

*Primary Examiner*—Kuang Y. Lin

*Attorney, Agent, or Firm*—Michael A. Ciomek; Eugene J. Kalil

[57] ABSTRACT

Reinforced composite aluminum-matrix articles containing a non-oxide reinforcing material, such as silicon carbide fibers or particles, are produced by a casting process wherein a small amount of lithium less than about 1%, by weight, is included in a melt of aluminum matrix alloy to facilitate wetting of the reinforcing material and ready dispersal thereof in the aluminum matrix alloy.

7 Claims, No Drawings

COMPOSITE MATERIAL HAVING MATRIX OF ALUMINUM OR ALUMINUM ALLOY WITH DISPERSED FIBROUS OR PARTICULATE REINFORCEMENT

The present invention deals with the production of composite materials having a matrix of aluminum alloy which is reinforced with discontinuous fibers or particulates made of dissimilar materials.

BACKGROUND OF THE INVENTION

It has been recognized in the art that the properties of aluminum matrix alloys could be improved in one or more important respects by dispersing throughout the matrix a dissimilar material having little or no solubility in the metal matrix. For example, graphite dispersed in aluminum improves the wear resistance thereof. Graphite, normally speaking, is insoluble in and immiscible with an aluminum melt and would be rejected from such a melt. The problem is solved in accordance with U.S. Pat. No. 3,885,959 by coating the surface with nickel, a metal which is wetted readily by molten aluminum thereby permitting ready dispersal of graphite particles in the aluminum matrix. Other dispersed solid particulate materials can improve the stiffness of modulus or other mechanical properties such as strength, etc. of composite materials having a matrix of aluminum or aluminum alloys. Dispersed silicon carbide is an example of a material which can improve the physical properties of aluminum or aluminum alloys. Other materials when dispersed in fibrous form can improve the strength of aluminum. U.S. Pat. No. 4,012,204 describes the production of fibrous compositions infiltrated with an aluminum lithium alloy. Articles such as (1) D. Webster, "Effect of Lithium on the Mechanical Properties and Micro-structure of SiC whisker Reinforced Aluminum Alloys," Metall. Trans. A, Vol. 13A, 1982, pp. 1511–1519; and (2) R. A. Page and G. R. Leverant, "Relationship of Fatigue and Fracture to Microstructure and Processing in $Al_2O_3$ Fiber Reinforced Metal Matrix Composites," Fifth International Conference on Composite Materials, TMS-AIME, Proceedings, 1986, pp. 867–886.

also deal with the problem.

In the production of composite materials having a metal matrix, three production methods have been recognized as follows:

(1) Solid-state or semi-solid-state consolidation;

(2) Pressure infiltration or squeeze casting; and (3) Casting.

Of the above-mentioned three methods, the casting method is the simplest but has been investigated the least. The casting method involves merely the mixing of molten matrix alloy and the reinforcing material at temperatures above the liquidus temperature of the matrix alloy. Once mixed, the molten alloy containing the suggested reinforcing material is solidified by casting in a mold or in the melting crucible.

The casting method has a cost advantage compared to the other methods mentioned and is adaptable to the production of large ingots. The problem with the casting method has been that difficulties have been encountered in wetting the reinforcing material with the molten matrix metal or alloy. Unless wetting of the reinforcing material is effected, rejection from the melt occurs.

SUMMARY OF THE INVENTION

In accordance with the invention, non-oxide reinforcing materials from the group consisting of silicon carbide fibers, silicon carbide particles, PAN (Polyacrylonitrile) and pitch-based carbon fibers may be dispersed in a molten bath of aluminum alloy which contains about 0.2% to about 1%, by weight, of lithium and mixing the solid discontinuous phase material with the aluminum alloy bath for a time sufficient to provide substantially complete dispersion of the solid material throughout the bath and then solidifying the bath while maintaining the dispersion.

DETAILED DESCRIPTION OF THE INVENTION

In accordance with the invention, the aluminum alloy bath to form the matrix of the final composition material may contain in addition to the requisite 0.2% to about 1%, by weight, of lithium, up to about 4% copper, up to about 4% silicon, up to about 4% magnesium, up to about 2% zinc; up to about 1% tin, up to about 2% iron, and the balance essentially aluminum.

The lithium present in the molten aluminum alloy bath aids in wetting the reinforcing material. For this purpose, a lithium content less than 1% is sufficient although lithium contents lower than about 0.2% by wt. of the bath are insufficient. The lithium content is kept below about 1% since the vapor pressure of lithium at the temperatures of the molten aluminum alloy is high resulting in rapid loss of lithium. In addition, excessive lithium contents in the bath produce difficulties in melting practice and introduce potential corrosion problems.

Particulate materials used as reinforcing materials in accordance with the invention will generally have an average particle size less than about 100 microns; e.g. about 5 to about 70 microns. Fibers introduced as dispersions may have an average diameter of about 8 to about 20 microns and an average length of about 200 to about 1000 microns.

The aluminum alloy matrix material may also contain elements such as copper and/or magnesium and/or silicon which contribute strengthening to the matrix. Titanium carbide fibers or particles can also be introduced in amounts up to 5% by volume, as titanium carbide surfaces are wetted by molten aluminum.

In producing the composite materials of the invention, the aluminum base matrix alloy is melted in a crucible which may, for example, be made of graphite and an appropriate amount of lithium either as a metallic lithium or as a master alloy containing up to about 10% lithium, may be introduced into the molten matrix alloy. The desired reinforcing material is then added in an amount up to about 30%, e.g. about 20% by volume, and mixed mechanically as by stirring. No pretreatment of the reinforcing material is necessary. The mixture of the molten metal alloy and particulate or fibrous reinforcing material is solidified either by casting into a mold or by cooling in the melting crucible. Continuous casting of the mixture may also be resorted to. The process can be carried out in a normal atmosphere. The solidified ingot may be further processed by extrusion, press-forging at a temperature at which the matrix alloy is partially melted, or by other forming processes or combinations thereof.

Examples will now be given.

A number of charges weighing from 450 to 640 grams of aluminum alloy of the type shown in the Table were melted in a graphite crucible surrounded by a vertical tubular furnace. Two to four grams of lithium were added to the molten metal and mixed therewith by stirring. Various reinforcing materials in various amounts as shown in the Table were added to the molten alloy and mixed by stirring using a screw-type motorized stirrer having four blades made of molybdenum. In each case, the crucible was removed from the furnace and cooled by forced air.

Details of the various experiments are given in the following Table. Of the heats shown in the Table, heats G8, G10, G20 and G22 were successfully extruded at a reduction ratio of about 10 to 1. Heat G20 was hot-pressed after extrusion at 630° C. (1165° F.), a temperature in the liquid-solid two-phase region for the alloy. Hot-pressing is a desirable production technique for forming the final desired product and also eliminates minor defects in the composite.

TABLE

| Heat | Matrix Al Alloy | | Reinforcing Material | | | | Li Addition | | |
|---|---|---|---|---|---|---|---|---|---|
| No. | Type | Grams | Type | Grams | Wt % | Vol % | Grams | Wt % | Result of Mixing |
| G-2 | 6061 | 650 | Carbon Fiber VMD | (65) | (9.1) | (11.9) | 0 | 0 | Did not wet. Mixing stopped when about 15 grams carbon fibers were put in the crucible. |
| G-3 | 6061 | 650 | Carbon Fiber VMD | 65 | 9.1 | 11.9 | 2 | 0.28 | Mixed well. |
| G-6 | 6061 | 600 | SiC Particulate M | 120 | 16.6 | 14.4 | 2 | 0.43 | Slight difficulties in mixing, but eventually mixed. |
| G-7 | 6061 | 625 | SiC Particulate M | 65 | 9.4 | 8.0 | 3 | 0.43 | Mixed adequately. |
| G-8 | 6061 | 650 | Carbon Fiber VMD | 65 | 9.1 | 11.8 | 3 | 0.42 | Mixed well. |
| G-9 | 6061 | 650 | SiC Particulate I | 65 | 9.0 | 7.7 | 4 | 0.56 | Mixed well. |
| G-10 | 6061 | 650 | SiC Particulate I | 85 | 11.5 | 9.8 | 4 | 0.54 | Mixed adequately. |
| G-13 | 6061 | 650 | SiC Whiskers | 65 | 9.4 | 8.0 | 4 | 0.58 | Mixed well. |
| G-16 | 6061 | 505 | SiC Particulate PH | 102 | 16.8 | 14.5 | 2 | 0.33 | Mixed well. |
| G-20 | 6063 | 600 | SiC Particulate PH | 130 | 17.8 | 15.4 | 2 | 0.27 | Mixed well. |
| G-21 | 6061 | 450 | SiC Particulate N | 120 | 19.2 | 16.8 | 0 | 0 | 4.8% TiC and 3.2% Si were added. Did not wet. |
| G-22 | 6061 | 490 | SiC Particulate N | 80 | 13.7 | 11.8 | 2 | 0.34 | 1.7% TiC was added. Mixed well. |

Reinforcing Materials:
Carbon Fiber VMD: Pitch-based chopped carbon fibers.
SiC Particulate M: About 1000 mesh.
SiC Particulate I: About 800 mesh.
SiC Particulate PH: 200 mesh-minus, 320 mesh-plus single crystal particulates.
SiC Particulate N: 400 mesh.

Composites produced in accordance with the invention have improved hardness as compared to the properties of the aluminum alloy matrix without the dispersed dissimilar phase.

For example, Heats No. G-20 and G-22 from the Table had a Vickers hardness of about 118 and 100 HV10, respectively, after extrusion and T4 heat treatment, whereas the base alloy showed 58 HV10 after the same treatments. It is also expected that the composites produced with the invention have higher strength, stiffness, and wear resistance than the base alloy.

It will of course be appreciated that fibrous materials distributed throughout a metal matrix by mixing will be randomly dispersed but will nevertheless strengthen the matrix as long as the fiber is wetted by the molten matrix metal and is firmly bonded thereto in the solid state.

Composite materials produced in accordance with the invention such as Alloy 6061 matrix material strengthened with about 3% to about 30%, by volume, of silicon carbide particles are useful in applications such as automotive connecting rods, piston pins, cums and gears.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. The method for producing a composite material having a matrix of aluminum-base alloy and up to about 30%, by volume, of a discontinuous phase from the group consisting of silicon carbide particles, silicon carbide fibers, PAN and pitch based carbon fibers, up to about 5%, by volume, of titanium carbide particles, which comprises preparing a bath of said aluminum-base alloy containing about 0.2% to about 1%, by weight, lithium, mixing said discontinuous phase material with said bath at a temperature above the liquidus temperature thereof for a time sufficient to provide substantially complete dispersion of said material throughout said bath and solidifying said bath while maintaining said dispersion.

2. The method in accordance with claim 1, wherein said aluminum-base alloy consists essentially of, by weight, up to about 4% copper, up to about 4% silicon, up to about 4% magnesium, up to about 2% zinc, up to about 1% tin, up to about 2% iron and the balance essentially aluminum.

3. The method in accordance with claim 1 wherein said particles have an average size of about 5 to about 70 microns.

4. The method in accordance with claim 1 wherein said fibers have an average diameter of about 8 to about 20 microns and an average length of about 200 to about 1000 microns.

5. The method in accordance with claim 1 wherein said mixing is accomplished by stirring.

6. The method in accordance with claim 1 wherein said mixed bath is cast into a static mold.

7. The method in accordance with claim 1 wherein said mixed bath is solidified by continuous casting.

* * * * *